US011478803B2

(12) United States Patent
Holzheimer et al.

(10) Patent No.: US 11,478,803 B2
(45) Date of Patent: Oct. 25, 2022

(54) SHOWER WITH PAUSE SETTING

(71) Applicant: Homewerks Worldwide, LLC, Lake Bluff, IL (US)

(72) Inventors: John C. Holzheimer, Chagrin Falls, OH (US); Martin D. Marsic, Highland Hts., OH (US)

(73) Assignee: HOMEWERKS WORLDWIDE, LLC, Lake Bluff, IL (US)

( * ) Notice: Subject to any disclaimer, the term of this patent is extended or adjusted under 35 U.S.C. 154(b) by 81 days.

(21) Appl. No.: 16/874,798

(22) Filed: May 15, 2020

(65) Prior Publication Data

US 2020/0360939 A1 Nov. 19, 2020

Related U.S. Application Data

(60) Provisional application No. 62/848,142, filed on May 15, 2019.

(51) Int. Cl.
*B05B 1/16* (2006.01)
*B05B 1/18* (2006.01)

(52) U.S. Cl.
CPC ..... *B05B 1/1636* (2013.01); *B05B 1/18* (2013.01)

(58) Field of Classification Search
CPC ..... B05B 1/16; B05B 1/1627; B05B 1/1636; B05B 1/1645; B05B 1/1654; B05B 1/1681; B05B 1/169; B05B 1/18; B05B 1/185; B05B 1/13; B05B 1/3026; B05B 1/30
See application file for complete search history.

(56) References Cited

U.S. PATENT DOCUMENTS

2012/0312899 A1* 12/2012 Miller ..... B05B 1/18 239/443
2014/0367482 A1* 12/2014 Cacka ..... E03C 1/0405 4/601
2018/0065131 A1* 3/2018 Rogers ..... B05B 1/1627

* cited by examiner

*Primary Examiner* — Darren W Gorman
(74) *Attorney, Agent, or Firm* — Cozen O'Connor

(57) ABSTRACT

A showerhead having a plurality of nozzle groups for dispensing water in a plurality of spray patterns, and a selector for selecting one or more of the nozzle groups for dispensing water or for pausing flow from the showerhead. When the selector is configured to pause flow from the showerhead a minimum flow is provided to each of the plurality of nozzle groups.

9 Claims, 2 Drawing Sheets

SHOWER WITH PAUSE SETTING

CROSS REFERENCE TO RELATED PATENTS AND APPLICATIONS

This application claims priority to and the benefit of the filing date of U.S. Provisional Patent Application Ser. No. 62/848,142, filed May 15, 2019, which application is hereby incorporated by reference.

BACKGROUND

The present exemplary embodiment relates to showerheads. It finds particular application in conjunction with showerheads having multiple spray patterns, and will be described with particular reference thereto. However, it is to be appreciated that the present exemplary embodiment is also amenable to other like applications.

Showerheads have been provided with various features for controlling the spray output. Such features include selector knobs, buttons, etc. for selecting one or more of a variety of spray patterns. Another feature that is sometimes provided is a pause feature wherein the spray output of the showerhead can be temporarily paused without having to turn off the main shower valve supplying water to the showerhead.

Most building codes allow a complete pause (e.g., zero flow) if the pause function cannot be "locked" (e.g., a user must manually hold a button down and then water begins flowing again upon release of the button). Various codes require that a showerhead with a pause function that can be "locked" in the pause setting have a certain minimum amount of flow (e.g., flow cannot be fully blocked). The reason for this minimum flow is safety. If water flow is shut off at the showerhead (with pause feature) using it like a shut off, the hot and cold water supplies of the house plumbing can mix. If the hot water is at a higher pressure than the cold, the hot water could migrate into the cold water plumbing via the showerhead. Then, the next person that gets into the shower could be scalded because hot water is in both lines.

In the past, the typical approach for providing the pause function to comply with the minimum flow requirements included selecting one of a plurality of spray patterns of the showerhead and providing a reduced diameter hole coming into that particular spray pattern's water channel (in addition to a regular sized hole). When the pause function is selected, water is directed through the reduced diameter hole and exits the showerhead via the single selected spray pattern.

The prior art approach of using a smaller diameter hole in communication with one of the spray patterns for the pause function is difficult for a couple reasons. First if the hole is too small, the back pressure will "blow off" the faceplate of the showerhead. Second, to avoid the first problem the hole must be made larger thus allowing more water to flow in the pause setting. As the amount of water flowing in the pause setting increases, the pause function may not appear to be properly operating as the water may maintain a spray pattern, albeit reduced from the normal operation. This can cause some users to conclude the showerhead is defective.

BRIEF DESCRIPTION

The present disclosure sets forth a showerhead with an improved pause function. In one example, a showerhead is configured to minimize the projection of water from its spray nozzles while in the pause function such that the pause function is not confused with one of the regular shower functions (e.g. full spray, concentrated spray, etc.)

In accordance with one aspect of the present exemplary embodiment, a showerhead comprises a plurality of nozzle groups for dispensing water in a plurality of spray patterns, a selector for selecting one or more of the nozzle groups for dispensing water or for pausing flow from the showerhead, wherein when the selector is configured to pause flow from the showerhead a minimum flow is provided to each of the plurality of nozzle groups. In one embodiment, the showerhead can include at least three nozzle groups.

The showerhead can include a flow plate having a plurality of flow channels each adapted to supply fluid to one of the three nozzle groups. Each of the flow channels can have a respective flow passageway for admitting water into a respective flow channel, and each flow channel can include a pause port. The inner shower plate can be circular, and the pause ports of each flow channel can be aligned along a radial direction of the flow plate. The pause ports and the flow passageways of each flow channel can be aligned circumferentially on the flow plate. The flow channels can extend circumferentially around at least a portion of the flow plate. The flow channels can be coaxial, and radially spaced apart. A ridge can separate radially adjacent flow channels.

In accordance with another aspect of the present exemplary embodiment, a method of pausing flow from a showerhead having a plurality of nozzle groups comprises simultaneously fluidly coupling each of the plurality of nozzle groups to a supply of fluid via individual reduced diameter flow passageways.

DETAILED DESCRIPTION

Figure 1:
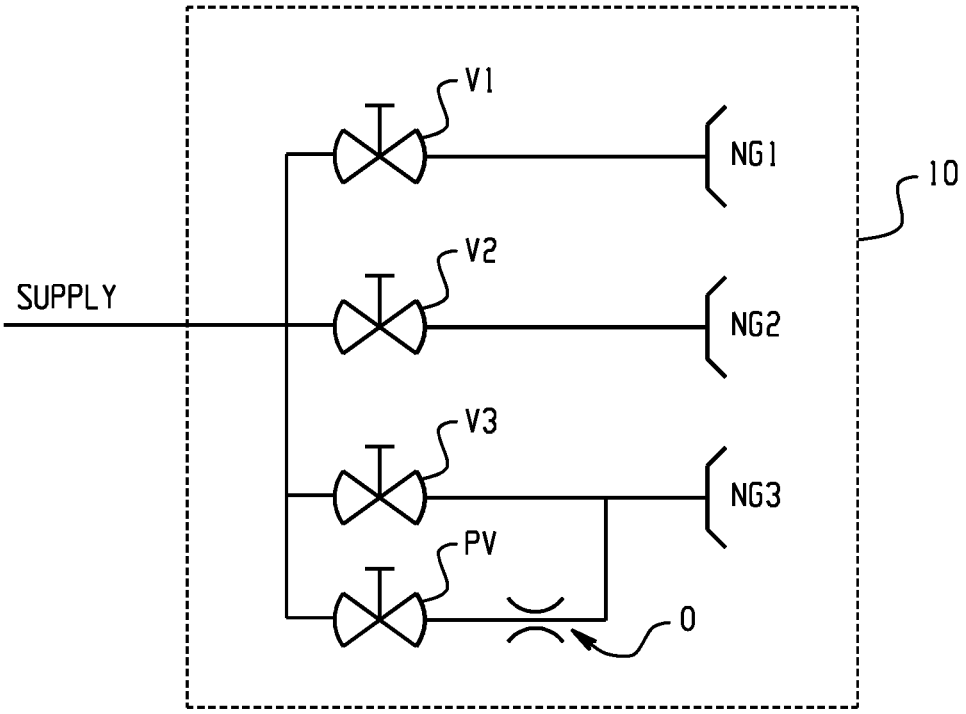
Fig. 1 PRIOR ART
FIG. 1 is a schematic diagram of a prior art showerhead.

With reference to FIG. 1, a prior art showerhead 10 is illustrated. The showerhead 10 includes three nozzle groups NG1, NG2 and NG3. Each nozzle group can be activated to provide a different spray pattern. Water is supplied to each nozzle group via a supply line and a respective valve V1, V2, and V3. The valves V1, V2, and V3 are shown as gate valves but in practice are typical comprises of flow passageways in an inner plate of the showerhead 10. The flow passageways can be selectively coupled to the supply line by rotation of a selector plate or other selector.

In general, each nozzle group can be configured to be activated alone by opening a respective one of the valves V1, V2 or V3, or combinations of the valves V1, V2 and V3 can be activated by opening combinations of the valves V1, V2 and V3.

In the prior art showerhead 10 of FIG. 1, a pause valve PV is associated with nozzle group NG3. The pause valve PV is opened to provide a low flow to nozzle group NG3 when the pause function is selected. It should be appreciated that an orifice O is provided for restricting flow to the nozzle group NG3 to provide a minimum flow rate to comply with the previously mentioned code requirements.

Figure 2:
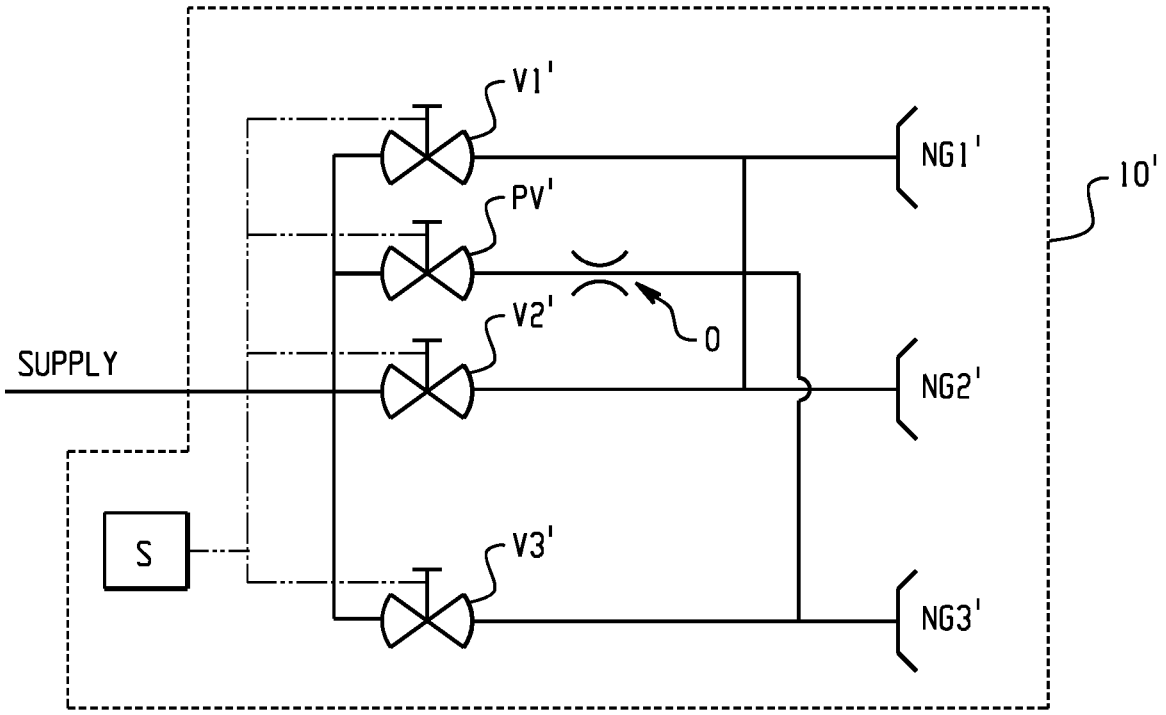
FIG. 2 is a schematic diagram of an exemplary showerhead in accordance with the present disclosure.

With reference to FIG. 2, and in accordance with the invention, a showerhead 10' is schematically illustrated. Although the showerhead 10' of the present disclosure is illustrated in schematic form, it will be appreciated that aspects of the present disclosure can be incorporated into a wide variety of existing showerhead configurations, including one or more of the showerhead configurations set forth in US Patent Publication No. 2017/0326561, which is hereby incorporated in its entirety in the present application.

The showerhead 10' includes three nozzle groups NG1', NG2' and NG3'. Each nozzle group NG1', NG2' and NG3' can be activated to provide a different spray pattern. Water is supplied to each nozzle group via a supply line and a respective valve V1', V2', and V3'. The valves V1', V2', and V3' are shown as gate valves but in practice are typically comprised of flow passageways in an inner plate of the showerhead 10'. The flow passageways can be selectively coupled to the supply line by rotation of a selector plate, shown in the schematic diagram as selector S. In practice, the selector S is a movable component of the showerhead that aligns a supply port with one or more of the flow passageways.

In general, each nozzle group NG1', NG2' and NG3' can be configured to be activated alone by opening a respective one of the valves V1', V2' or V3', or combinations of the valves V1', V2' and V3' can be activated by opening combinations of the valves V1', V2' and V3'.

A pause valve PV' is fluidly coupled to each of the nozzle groups, and an orifice O' is provided for restricting flow to the nozzle groups to provide a minimum flow rate to comply with the previously mentioned code requirements. In contrast to the prior art showerhead 10 of FIG. 1, when the pause valve PV' is opened, fluid is supplied to each of the nozzle groups as opposed to a single nozzle group. Thus, for a given orifice size the increase in outlet area realized by activating all three nozzle groups results in a decrease in the pressure of the fluid flowing from the showerhead 10'. This results in the showerhead 10' having the appearance of much lower output flow in the pause setting. In some examples, the output flow merely trickles from the showerhead 10' as opposed to the prior art designs that maintain some spray pattern. Accordingly, users of the showerhead 10' are more likely to consider the pause function of the showerhead of the present disclosure to be effective.

Figure 3:
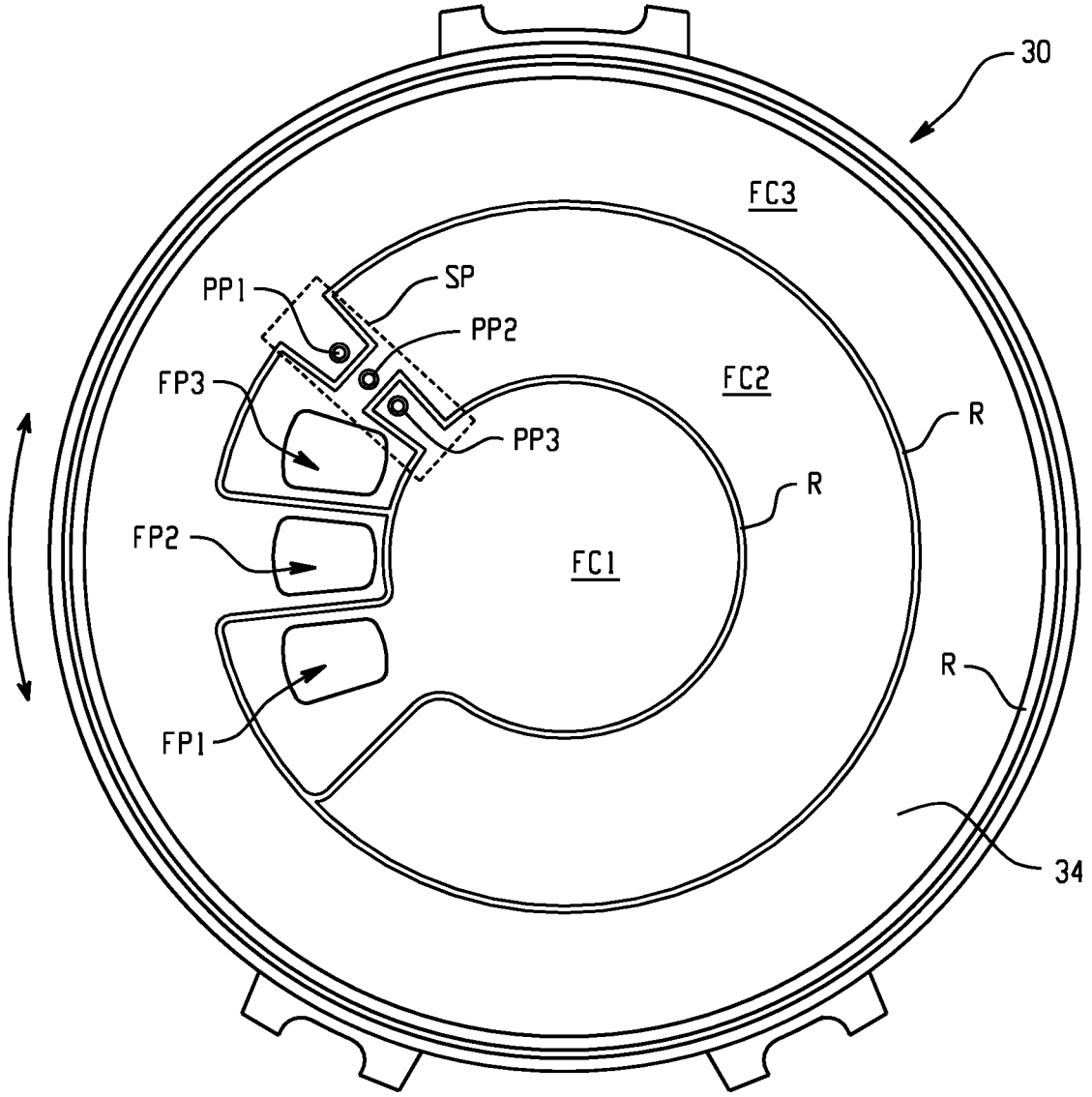
FIG. 3 is a plan view of an inner plate (flow plate) of a showerhead in accordance with the present disclosure.

Turning to FIG. 3, an exemplary inner shower plate (flow plate) 30 in accordance with the present disclosure is shown. It will be appreciated that the inner plate 30 is generally supported in a showerhead for rotation such that a user can select a desired spray pattern. In some instances, the inner shower plate 30 may be coupled to a showerhead face that is rotated to select a desired spray pattern. As will be described below, rotation of the inner shower plate 30 fluidly couples and/or decouples a plurality of ports from a supply of fluid.

The inner plate 30 includes a plate body 34 having a plurality of flow passageways delineated by a plurality of ridges R for fluidly connecting a supply line to various nozzle groups, such as nozzle groups NG1, NG2 and NG3 in FIG. 2, via flow channels FC1, FC2, and FC3, respectively. For example, flow passageway FP1 fluidly couples the supply to a concentrated spray pattern nozzle group via the innermost flow channel FC1, flow passageway FP2 fluidly couples the supply to a full spray pattern nozzle group via flow channel FC3, and FP3 fluidly couples the supply to a massage spray nozzle group via flow channel FC2.

It should be appreciated that when any of the flow passageways are aligned with a supply port of the showerhead SP, fluid is supplied to the respective nozzle groups. Fluid is supplied to one or more of the flow passageways from behind the plate such that the fluid flows in a direction coming out of the page as it passes through the flow passageways, and then is distributed to the nozzle groups via the flow channels. In this regard, it is possible that two or more of the flow passageways can be aligned with the supply port to simultaneously supply fluid to more than one nozzle group.

The plate body 34 further includes a plurality of pause passageways PP1, PP2, and PP3 that couple the supply port SP to each of the concentrated spray pattern nozzle group, full spray pattern nozzle group, and massage spray nozzle group when aligned with the supply port such that the minimum flow of the pause setting is distributed to all nozzle groups. The pause passageways PP1, PP2 and PP3 have a relatively small diameter to restrict flow (e.g., metering orifice) to the nozzle groups to thereby maintain a minimal amount of flow (e.g., 0.5 gallons total flow per minute) through the showerhead when the pause feature is enabled.

The pause passageways PP1, PP2 and PP3, and the flow passageways FP1, FP2 and FP3 are all aligned circumferentially on the inner shower plate 30 such that rotation of the inner shower plate 30 aligns one or more of the passageways with the supply port SP. In general, any flow passageway, or the pause passageways, when not aligned with the supply port, will be sealed by a suitable seal member to prevent backflow of fluid through the flow channels between the pause passageways and the flow passageways. For example, when the pause feature is enabled as shown in FIG. 3, each of flow passageways FP1, FP2 and FP3 will be sealed off to prevent water from flowing through the flow channels and back out the flow passageways.

Although the plate 30 is shown with three flow passageways and three flow channels, any number of flow passageways and flow channels can be provided depending on the number of nozzle groups a particular showerhead includes. As a general principle, it is desirable that the number of pause passageways correspond to the number of flow passageways such that all of the nozzle groups participate in the pause function. By activating all of the nozzle groups during the pause function, the pressure of the fluid exiting the nozzle groups can be lowered a maximum amount to reduce or eliminate any spray pattern from the showerhead. In some examples, the resulting flow from the showerhead in pause mode is a mere trickle, and no spray pattern is observed.

It should be appreciated that the orifice O' shown schematically in FIG. 2 corresponds to the reduced diameter pause passageways in FIG. 3 that meter the flow of fluid to the nozzle groups when fluidly coupled with the supply port.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A showerhead comprising a plurality of nozzle groups configured to dispense water in a plurality of spray patterns; and a selector configured to select between:

(a) a water dispensing condition of the showerhead in which one or more of the nozzle groups dispense water, and (b) a pause flow condition of the showerhead in which flow from the showerhead is paused, wherein the selector is configured, in the pause flow condition of the showerhead, to pause the flow from the showerhead, such that at least a minimum flow is provided to each and every one of the plurality of nozzle groups.

2. The showerhead of claim 1, wherein the showerhead includes at least three nozzle groups, and wherein when the selector is configured to pause flow from the showerhead, water is supplied to each of the at least three nozzle groups via at least one metering orifice.

3. The showerhead of claim 2, wherein the showerhead includes, as the selector, an inner shower plate having a plurality of flow channels each adapted to supply fluid to a respective one of the at least three nozzle groups.

4. The showerhead of claim 3, wherein each of the flow channels has a respective flow passageway for admitting water into a respective flow channel, and each flow channel includes a pause port having the metering orifice.

5. The showerhead of claim 4, wherein the inner shower plate is circular, and wherein the pause ports of each flow channel are aligned along a radial direction of the inner shower plate.

6. The showerhead of claim 5, wherein the pause ports and the flow passageways of each flow channel are aligned circumferentially on the inner shower plate.

7. The showerhead of claim 6, wherein the flow channels extend circumferentially around at least a portion of the inner shower plate.

8. The showerhead of claim 7, wherein the flow channels are coaxial, and radially spaced apart.

9. The showerhead of claim 8, wherein a ridge separates radially adjacent flow channels.

* * * * *